US011064759B2

(12) United States Patent
Olsson et al.

(10) Patent No.: US 11,064,759 B2
(45) Date of Patent: Jul. 20, 2021

(54) SHOE CONSTRUCTIONS

(71) Applicant: GLASS SLIPPER D.O.O., Belgrade (RS)

(72) Inventors: Jelena Olsson, London (GB); Yuta Sugawara, London (GB); Sergio Dulio, London (GB); Catherine Day, London (GB)

(73) Assignee: Glass Slipper D.O.O., Belgrade (RS)

( * ) Notice: Subject to any disclaimer, the term of this patent is extended or adjusted under 35 U.S.C. 154(b) by 118 days.

(21) Appl. No.: 16/078,831

(22) PCT Filed: Feb. 22, 2017

(86) PCT No.: PCT/GB2017/050452
§ 371 (c)(1),
(2) Date: Aug. 22, 2018

(87) PCT Pub. No.: WO2017/144872
PCT Pub. Date: Aug. 31, 2017

(65) Prior Publication Data

US 2019/0045878 A1 Feb. 14, 2019

(30) Foreign Application Priority Data

Feb. 22, 2016 (GB) ..... 1603009

(51) Int. Cl.
*A43B 3/24* (2006.01)
*A43B 13/36* (2006.01)
(Continued)

(52) U.S. Cl.
CPC ..... *A43B 3/246* (2013.01); *A43B 3/242* (2013.01); *A43B 3/244* (2013.01); *A43B 13/28* (2013.01); *A43B 13/36* (2013.01); *A43B 21/36* (2013.01)

(58) Field of Classification Search
CPC ..... A43B 3/246; A43B 3/242; A43B 3/244; A43B 3/24; A43B 3/16; A43B 3/18;
(Continued)

(56) References Cited

U.S. PATENT DOCUMENTS 2,873,540 A * 2/1959 Murphy ..... A43B 3/24 36/101
3,846,919 A * 11/1974 Milotic ..... A43B 13/28 36/100
(Continued)

FOREIGN PATENT DOCUMENTS

DE 10139024 A1 * 3/2003 ..... A43B 13/36
FR 3023682 A1 * 1/2016 ..... A43B 3/18
WO WO-2012054981 A2 * 5/2012 ..... A43B 3/246

OTHER PUBLICATIONS

English machine translation of DE 10139024 A1. Via espacenet.com. Translation performed on Sep. 16, 2020. (Year: 2003).*

*Primary Examiner* — Jameson D Collier
(74) *Attorney, Agent, or Firm* — Renner, Kenner, Greive, Bobak, Taylor & Weber

(57) ABSTRACT

A shoe assembly includes a base shoe (10), a removable outsole (25) and a removable cover (22). The base shoe (10) is defined by a skeleton insole (11) having a lower surface, a heel component (12), and an upper (13) rising from the periphery of the skeleton insole (11). The upper (13) defines a foot-retaining element. The removable outsole (25) is connected to the skeleton insole (11) to overlie the lower surface thereof. There is a releasable mechanism having a first part on the skeleton insole (11) and a second part on the outsole (25) to interconnect the two. The removable cover (22) is for the upper (13), and fits over the base shoe (10) to overlie the foot-retaining element. The cover (22) has a sole region provided with a sole opening for accommodation of the releasable mechanism interconnecting the outsole (25)
(Continued)

with the skeleton insole (11). The cover (22) also has a heel opening (23) through which at least a part of the heel component (12) passes. A part of the cover (22) is located between the lower surface of the skeleton insole (11) and the outsole (25), to retain the cover (22) on the base shoe (10).

17 Claims, 14 Drawing Sheets

(51) Int. Cl.
*A43B 21/36* (2006.01)
*A43B 13/28* (2006.01)

(58) Field of Classification Search
CPC ..... A43B 3/20; A43B 13/28; A43B 21/36; A43B 21/00; A43B 21/39; A43B 21/40; A43B 21/44; A43B 21/437; A43B 21/45; A43B 21/46; A43B 21/47; A43B 21/48; A43B 21/51
USPC ..... 36/100, 34 R, 101, 24.5, 42
See application file for complete search history.

(56) References Cited

U.S. PATENT DOCUMENTS

| | | | | | |
|---|---|---|---|---|---|
| 3,906,646 | A * | 9/1975 | Milotic | A43B 13/28 | 36/100 |
| 4,835,884 | A * | 6/1989 | Bianchini | A43B 13/28 | 36/108 |
| 5,953,836 | A * | 9/1999 | Watt | A43B 3/24 | 36/100 |
| 6,151,800 | A * | 11/2000 | Kerr | A43B 3/20 | 36/7.2 |
| 2007/0011918 | A1* | 1/2007 | Snow | A43B 23/22 | 36/108 |
| 2013/0263468 | A1* | 10/2013 | Ciccarelli | A43B 3/16 | 36/7.1 R |
| 2015/0113831 | A1* | 4/2015 | Weingart | A43B 5/18 | 36/87 |
| 2016/0106178 | A1* | 4/2016 | Monger | A43B 3/16 | 36/7.1 R |

* cited by examiner 6
15
13
5
10
4
14
18
6
12
5
25
4

10
9
11
10
13
18
15
3
3
7
7
16
11
11
10
9

SHOE CONSTRUCTIONS

This invention relates to a shoe construction having a base shoe and a cover therefor. In particular, but not exclusively, the invention concerns a shoe construction for a shoe with an elevated heel, as well as a method of providing a base shoe with a cover. Further, the invention relates to a cover per se for such a shoe.

In this specification, the term "elevated heel shoe" is intended to refer to a shoe having any kind of raised heel arrangement and particularly, but not exclusively, to so-called high heel shoes such as are usually worn by ladies. Though there is no universal definition of the term "high heel shoe" it is generally agreed that a heel height of less than 25 mm (1 inch) is a low heel, a heel height of between 25 mm and 75 mm (1 inch and 3 inches) is a medium heel and a heel height of greater than 75 mm (3 inches) is a high heel. As will be understood from the following description of this invention, it primarily concerns medium and high heel shoes but could be used in conjunction with low heel shoes.

Many people find relatively inexpensive medium and high heel shoes somewhat uncomfortable to wear for extended periods, or for walking any significant distance. Comfort is often very much greater with so-called luxury (i.e. relatively expensive) medium and high heel shoes but then many people are deterred from buying several pairs of shoes to suit different occasions or moods, in view of the expense. Thus, an intending wearer of high heel shoes for a special occasion, such as a wedding, may be reluctant to buy a pair of shoes just for that occasion, recognising that those shoes may be inappropriate for everyday wear.

A further problem with luxury high heel shoes is that in the event the shoe might be damaged accidentally, the shoes will be thrown away rather than worn with a scuff or other damage. Again, this may make a wearer of the shoes reluctant to wear luxury high heel shoes for everyday use, in view of the cost of perhaps relatively minor damage to the shoes.

It is a principal aim of the present invention to address the problems discussed above, of having to buy an expensive pair of shoes for just one occasion or of damaging a luxury pair of shoes and then, in either case, not being able to wear those shoes subsequently, or being unwilling to do so.

According to one aspect of this invention, there is provided a shoe assembly comprising:

- a base shoe defined by a skeleton insole having a lower surface, a heel component, and an upper rising from the periphery of the skeleton insole, the upper defining at least one foot-retaining element;
- a removable outsole connected to the skeleton insole to lie against the lower surface of the skeleton insole, there being a releasable mechanism having a first part on the skeleton insole and a second part on the outsole to interconnect the outsole to the skeleton insole; and
- a removable cover for the upper, the cover fitting over the base shoe to overlie said at least one foot-retaining element, the cover having a sole region provided with a sole opening for accommodation of the releasable mechanism interconnecting the outsole with the skeleton insole, and a heel opening through which at least a part of the heel component passes whereby a part of the cover is located between the lower surface of the skeleton insole and the outsole, thereby to retain the cover on the base shoe.

It will be appreciated that with the shoe construction of this invention, and in particular in its preferred form of an elevated heel luxury shoe as will be described below, there is provided a base shoe and a removable cover for that base shoe. Though there have been previous proposals for covers for elevated heel shoes, such as in U.S. Pat. No. 8,413,351 or US2013/0263468, either those covers have not been easily user-replaceable or inter-changeable, or the covers when fitted are unsightly and wholly inappropriate for a luxury high heel shoe. By contrast, the shoe construction of this invention allows the provision of a high or medium heel shoe, but possibly also a low heel shoe, which has an aesthetically pleasing appearance and yet which allows the replacement of the shoe upper cover in the event that the original cover is damaged or merely because the wearer of the shoes wishes to present a different aesthetic appearance. As an adjunct, the base shoe may be of high quality, and so relatively expensive, but that should not deter an intended purchaser in view of the possibility of changing the significantly less expensive covers.

The releasable mechanism may comprise a socket opening into the skeleton insole from the lower surface thereof and a support of a complementary form to the socket projecting from the upper surface of the outsole and receivable in the socket. Alternatively, the outsole may be connected to the skeleton insole by means of a socket opening into the outsole from the upper surface thereof and a support of a complementary form to the socket projecting from the lower surface of the skeleton insole and receivable in the socket. Either way, a releasable snap-fit connection mechanism may be provided between the support and the socket whereby the outsole is removable from the skeleton insole by breaking apart the snap-fit connection mechanism.

Where a snap-fit connection mechanism is provided, that may comprise at least one spring-loaded plunger on the support or within the socket, and a corresponding recess in the other of the socket and the support, respectively, to receive the plunger. Alternatively, the snap-fit connection may comprise a lug on one of the skeleton insole and the outsole and having a resiliently deformable blade receivable in a correspondingly formed socket in the other of the skeleton insole and the outsole. Yet another possibility is for the snap-fit connection to comprises a pair of resiliently deformable lugs upstanding from one of the skeleton insole and the outsole and each lug having barb formation at its free edge, there being a correspondingly formed socket in the other of the skeleton insole and the outsole and having a respective recess for each barb.

Preferably, the heel component comprises a heel attachment element associated with the skeleton insole and a heel member removably attached to the heel attachment element. In this case, the heel opening of the removable cover should fit to the heel attachment element whereby the region of the cover around the heel opening therein is trapped between the skeleton insole and the heel member. The heel attachment element may comprise a heel pin projecting from the skeleton insole, and the heel opening of the removable cover fits around the heel pin. This arrangement allows the heel member to be interchangeable with at least one other heel member of the same or a different form.

It is preferred for the removable cover to be elastically deformable. The cover may have an upper part to overlie the base shoe upper and at least one base panel to overlie at least part of the lower surface of the skeleton insole. The base panel may have an opening to receive the heel component, the edge of the opening being profiled to fit within a groove formed between the skeleton insole and the heel component, around at least part of the periphery of the heel component. Alternatively, the opening may be profiled to be trapped between the heel member and the skeleton insole when the heel member is secured thereto, in the case of a removable heel member.

The foot retaining element of the upper may comprise a vamp and a quarter panel, and the removable cover is configured to overlie the vamp and the quarter panel.

According to a second aspect of this invention, there is provided a method of manufacturing a shoe comprising the steps of:

providing a base shoe defined by a skeleton insole having a lower surface, a heel component, and an upper rising from the periphery of the skeleton insole, the upper defining at least one foot-retaining element;

providing a removable outsole to overlie the lower surface of the skeleton insole, there being a releasable mechanism having a first part on the skeleton insole and a second part on the outsole to interconnect the outsole to the skeleton insole; and providing a removable cover for the upper, the cover having openings in a base panel for the heel component and the connection mechanism;

in which method:

the cover is stretched over the base shoe to overlie the at least one foot retaining element of the base shoe upper and to overlie at least part of the lower side of the skeleton insole;

the region of the base panel having an opening for the heel component is trapped between the heel component and the skeleton insole; and the outsole is fitted to the skeleton insole by way of the releasable connection mechanism, thereby trapping part of the cover base panel between the skeleton insole and the outsole, thereby retaining the cover on the base shoe.

In the method of this invention, the heel component may be removable from the base shoe. In this case the cover may be fitted to the base shoe before the heel component is secured thereto, and following the fitting of the cover, the heel component is secured to the base shoe to trap part of the cover base panel between the heel component and the skeleton insole.

According to a third aspect of this invention, there is provided a removable cover for a shoe assembly of this invention as described above and having an upper part to overlie the upper of the base shoe and a base panel to overlie the lower surface of the skeleton insole, the base panel having an opening for the connection mechanism and a further opening for the heel component.

By way of example only, various embodiments of this invention will now be described in detail, reference being made to the accompanying drawings, in which.

Figure 1:
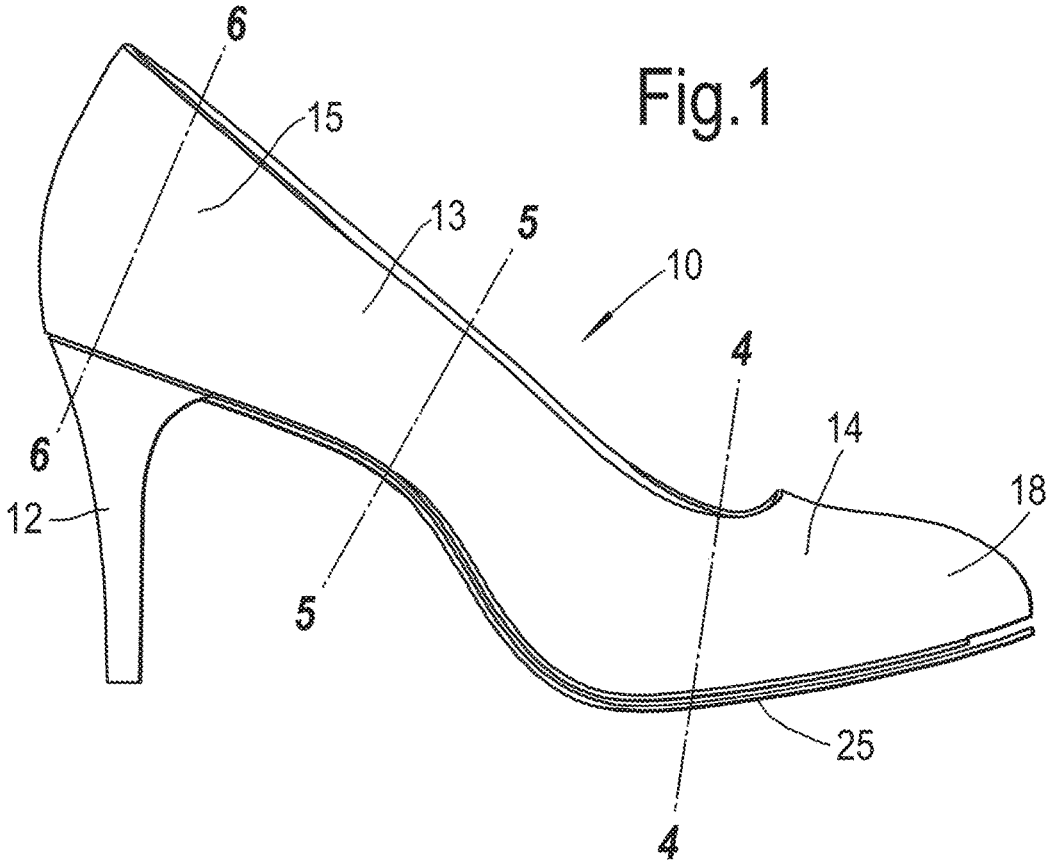
FIG. 1 is a side view of a base shoe as used in a first embodiment, with various section lines marked thereon.

Reference will initially be made to FIGS. 1 to 11 of the accompanying drawings, showing an example of a base shoe 10 for use in the provision of a high heel shoe as an example of this invention. The base shoe 10 has a skeleton insole 11 (sometimes referred to as a manufacturing insole or a footbed) provided with a heel component 12 secured to the rear (heel) end of the skeleton insole. An upper 13 rises from the periphery of the skeleton insole, so as to define a vamp 14 and a quarter 15 merging into each other. The skeleton insole 11 and the upper 13 are moulded integrally from plastic materials, but are co-moulded from different materials with different Shore hardnesses. The skeleton insole is of the harder material has mechanical design features to retain the required rigidity and structural strength for example by way of grooves 16 formed therein.

FIGS. 3 to 7 show cross-sections through different parts of the upper, and as can be seen the upper does not have a constant thickness whereby the required strength and rigidity can be imparted thereto. This also allows the upper to retain its required shape when fitted with a removable cover as will be described hereinafter, especially if the cover itself is of a relatively stiff material. Further, the upper is designed to provide comfort for a wearer and to facilitate retention of the shoe on the foot of a wearer, by virtue of the inside profile given to the upper.

Figure 2:
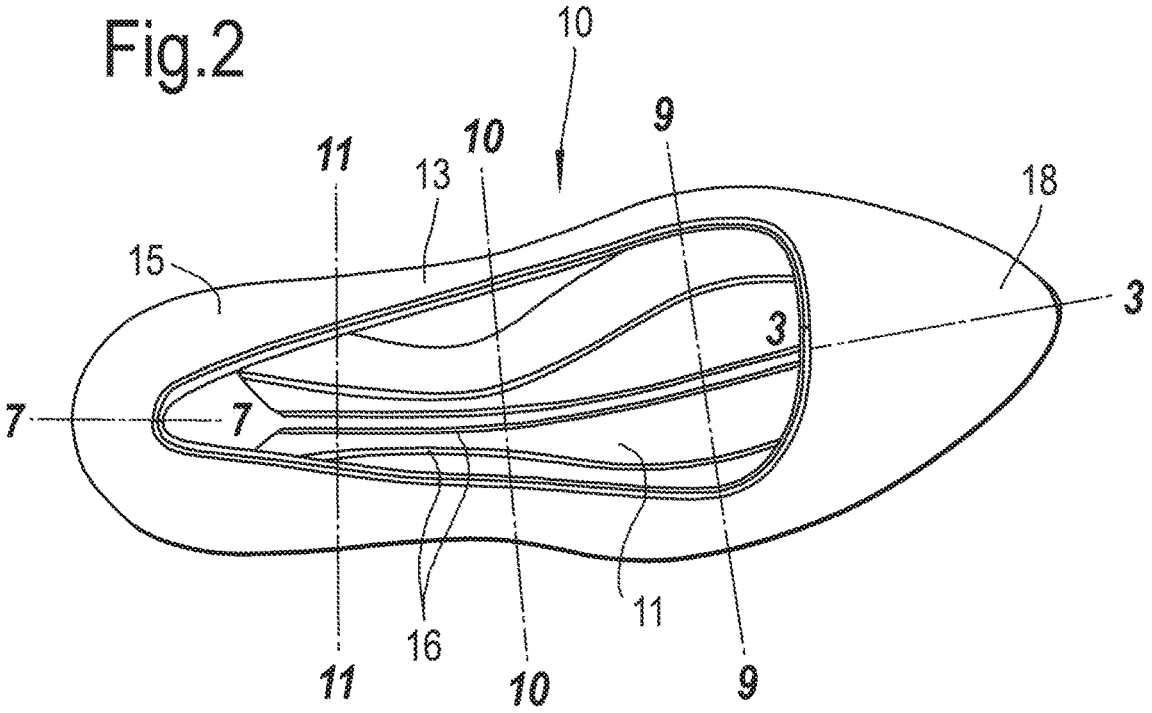
FIG. 2 is a plan view on the base shoe of FIG. 1, again with various section lines marked thereon.
Figure 3:
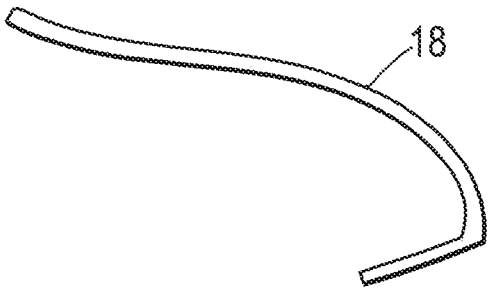
FIGS. 3 to 7 are sections through the upper of the base shoe, taken on the respective section lines marked on FIGS. 1 and 2.
Figure 4:
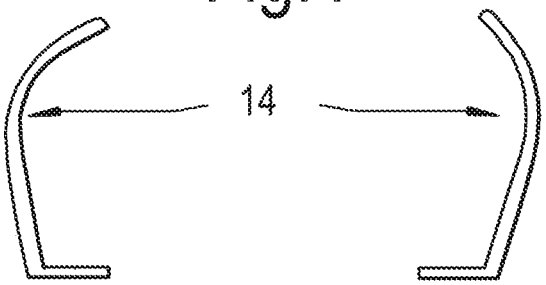
Figure 5:
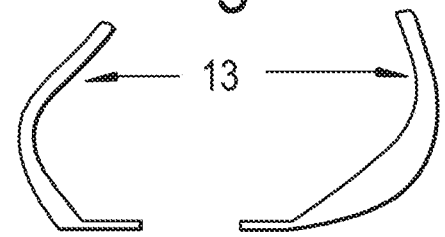
Figure 7:
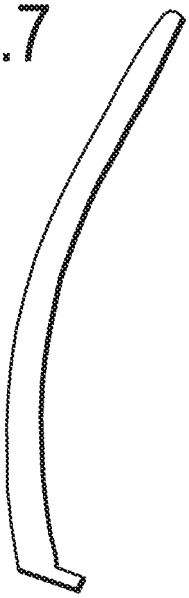
Figure 6:
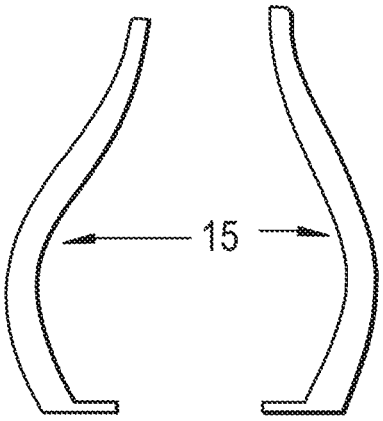

FIG. 3, taken on line 3-3 on FIG. 2, shows that the toe cap 18 has a substantially uniform thickness, as do the sides where the toe cap joins the sides of the upper (FIG. 4). The arch region of the upper is thinner at the top, but thicker at the bottom adjacent the skeleton insole, especially internally (FIG. 5). The sides of the upper in the heel area are thinner at the top than at the bottom (FIG. 6). The wall thickness at the rear of the heel area (FIG. 7) is thinner at the top and thicker at the bottom, as with the sides of the heel area, though less pronounced.

Figure 8:
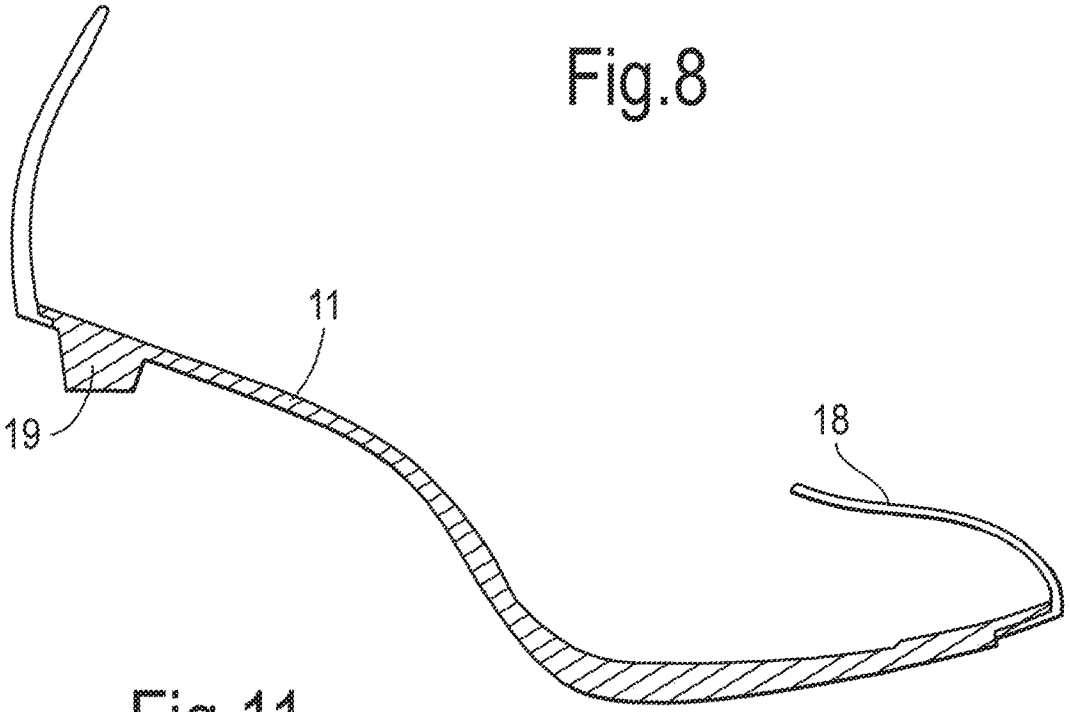
FIG. 8 is a longitudinal section through the base shoe comprising a skeleton insole co-moulded with the upper.
Figure 11:
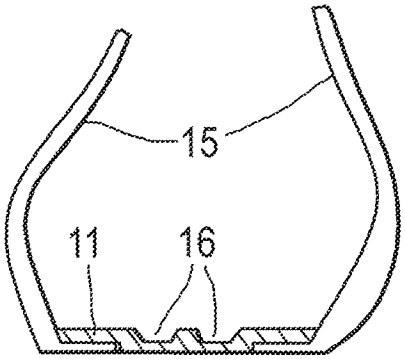
FIGS. 9 to 11 are sections through the base shoe skeleton insole and upper, taken on the respective section lines marked on FIG. 2.
Figure 9:
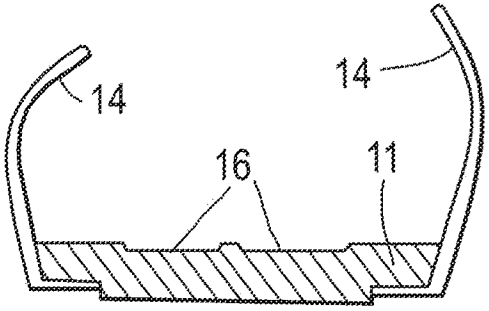
Figure 10:
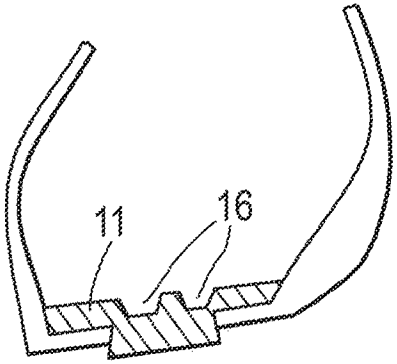

FIG. 8 is a longitudinal cross-section through the base shoe 10, showing the skeleton insole 11 co-moulded with the upper 13. The skeleton insole 11 includes an attachment boss 19 for the heel component 12 (FIG. 1). That heel component may be secured in position using standard shoe-making techniques, such as by inserting screws from within the seat of the heel area into the heel component. In the alternative, and as will be described below, the heel component may be user-removable, to allow substitution of one heel component by another perhaps of a different style, profile, colour or decoration. In the case of a fixed heel component as just described, there is a narrow gap between the lower surface of the skeleton insole 11 and the periphery of the heel component 12, as shown for example in FIG. 14, for a purpose to be described below.

Though not shown in the drawings, the base shoe is completed by providing a conventional insole within the shoe base on the inner surface of the skeleton insole, to create a layer between the upper surface of the skeleton insole and the wearer's foot. Also, a lining may be provided on the inside of the shoe, around the vamp and quarter. The insole and lining serve to improve comfort for the wearer and also can help to increase the life span of the shoe; the insole and lining may be essentially conventional, and are well known in the shoe-making art.

Figure 12:
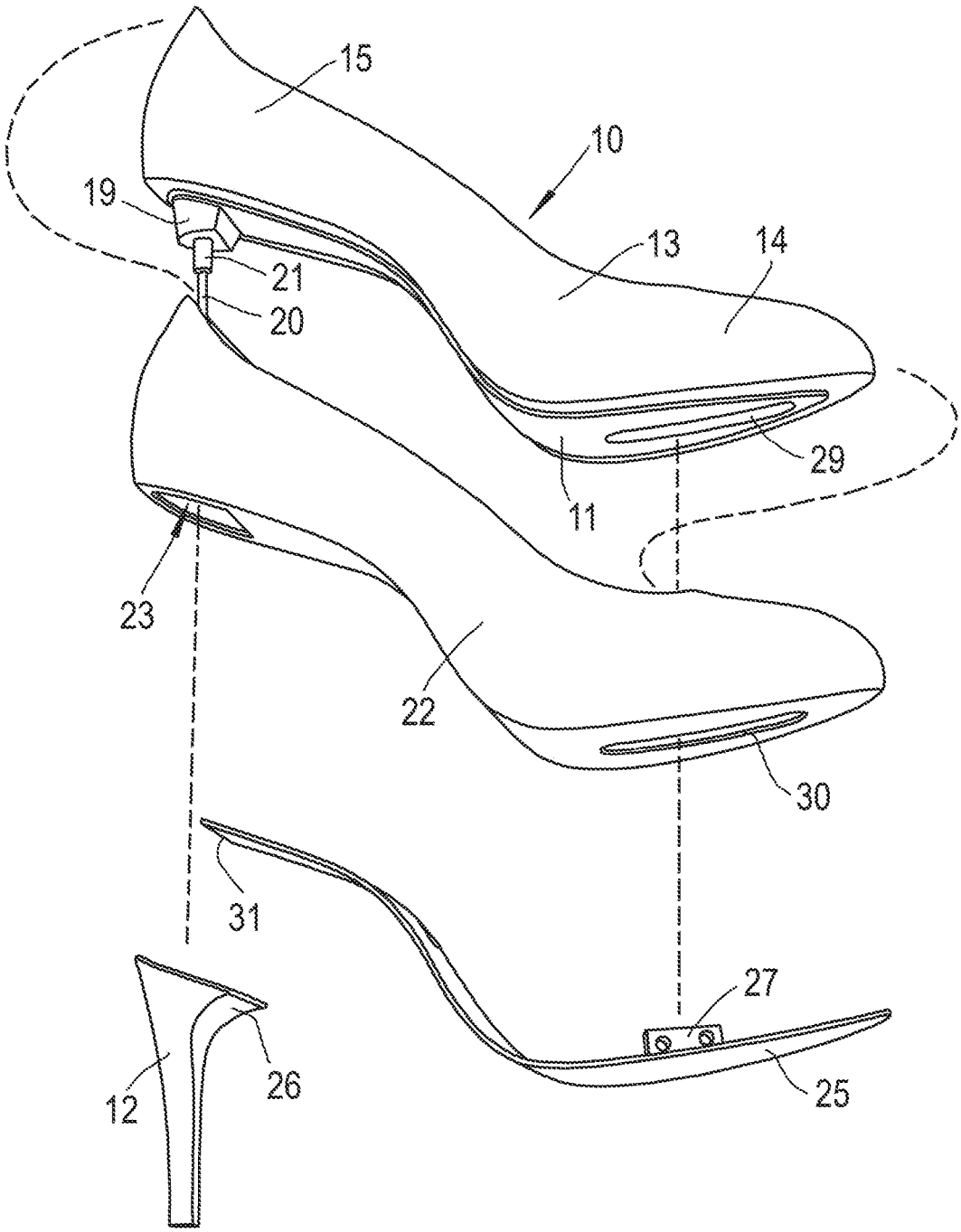
FIG. 12 shows an example of a complete shoe, comprising a base shoe, a cover, an outsole and a heel component with the parts separated for clarity.

FIG. 12 shows a complete shoe construction using a base shoe 10 as shown in FIG. 1. The base shoe has a metal heel pin 20 secured to the heel region of the skeleton insole so as to project downwardly from the attachment boss 19. This may be achieved, for example, by means of a screw threaded into the enlarged head 21 at the upper end of the heel pin. The heel component 12 has a bore configured to be a close sliding fit on the heel pin 20 and is provided with an attachment arrangement to secure the heel component to the pin. That attachment arrangement forms no part of this invention and will not be described in further detail here, but a reference may be made to our co-pending International Application No. WO 2014/145153 for examples of suitable attachment arrangements.

The shoe construction includes a removable cover 22 adapted to confer aesthetic qualities to the finish and style of the shoe and may be made from any suitable material for this purpose. For example, the cover may be made from a natural or synthetic leather, or from a textile or plastic material suitably coloured or otherwise decorated. The cover 22 may be stretchy to some extent, to facilitate the fitting of the cover over the base shoe as shown by the dotted lines in FIG. 12; thus, the toe cap 18 is fitted into the toe region of the cover while the heel pin 20 is passed through an opening 23 in the cover, the opening being of a suitable size and shape to be a snug fit around the attachment boss 19.

An outsole 25 is provided for the shoe, the outsole being of a suitable shape and size to be a snug fit against the undersurface of the skeleton insole 11 (before fitting of the cover 22) and to the upper end of the breast 26 of the heel component 12. The outsole is releasably connected to the skeleton insole 11 by way of a mechanism including a support 27 provided on the upper surface of the outsole 25 and carrying a pair of double-ended spring-loaded plungers 28 described in more detail with reference to FIGS. 21A and 21B below, the underside of the skeleton insole 11 being provided with a socket 29 for receiving the support 27. The opposed sides of the socket have recesses (shown in FIG. 18) into which the spring-loaded plungers of the outsole 25 are received, thereby to hold the outsole to the skeleton insole.

The cover 22 has an opening 30 formed therein generally aligned when in use with the socket 29 of the skeleton insole 11, such that when the cover is fitted to the base shoe, the support 27 of the outsole 25 may be snap-fitted into the socket in the skeleton insole, thereby trapping the lower edges of the cover 22 between the skeleton insole and the outsole. Finally, the shoe is completed by fitting the heel component 12 to the heel pin 20, the arrangement being such that the rear edge 31 of the outsole 25 is trapped by the heel component when locked to the heel pin 20, thereby completing the shoe.

Figure 13:
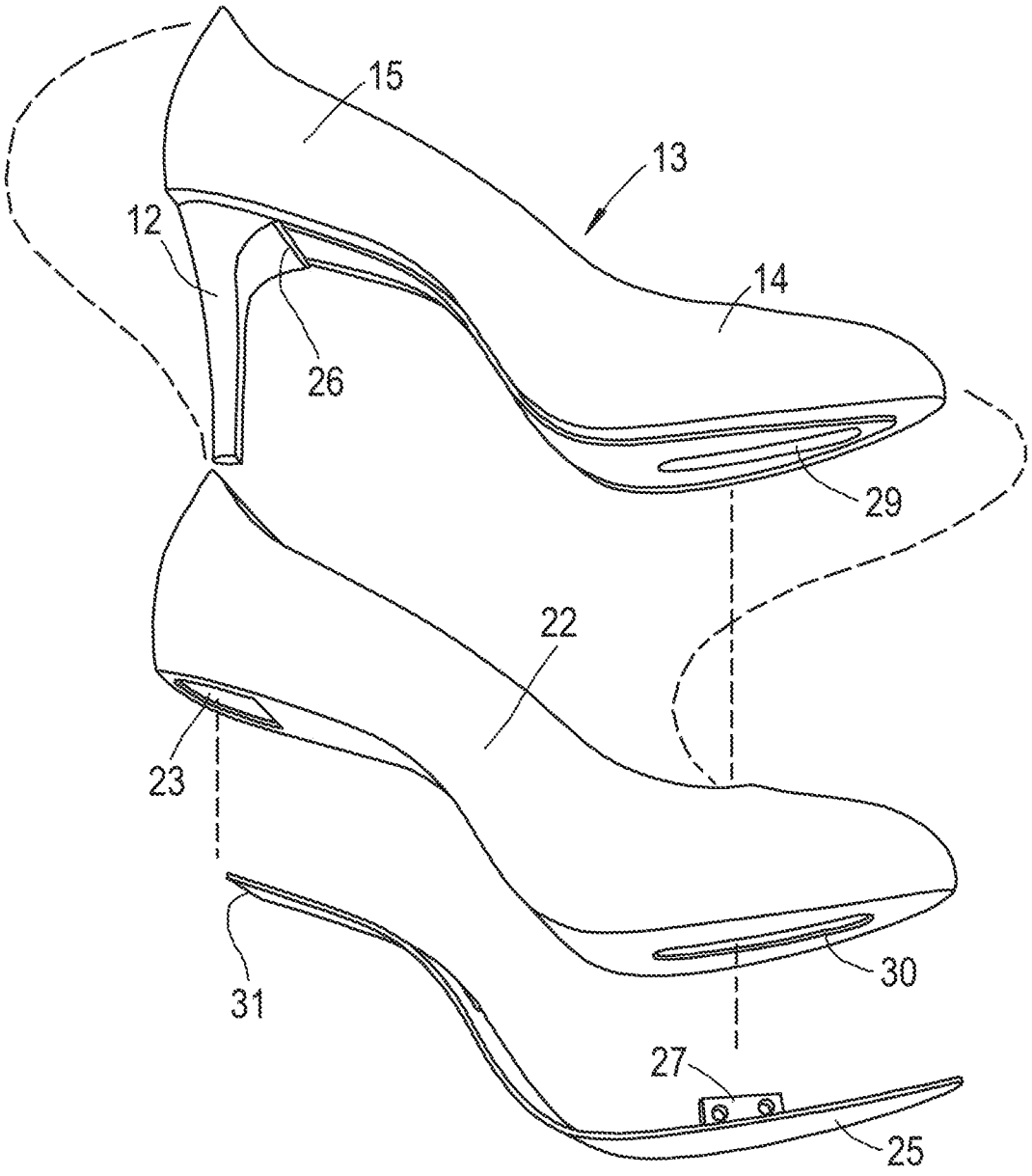
FIG. 13 shows an alternative example of a complete shoe also comprising a base shoe, a cover, an outsole and a heel component with the parts separated for clarity.
Figure 14:
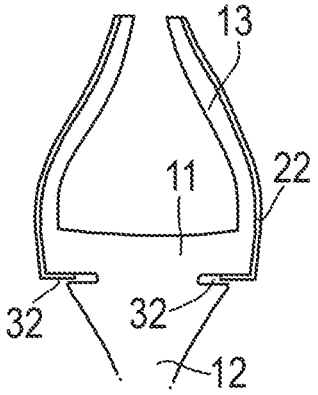
FIG. 14 is a cross-section through the heel region of the example of FIG. 13.
Figure 15:
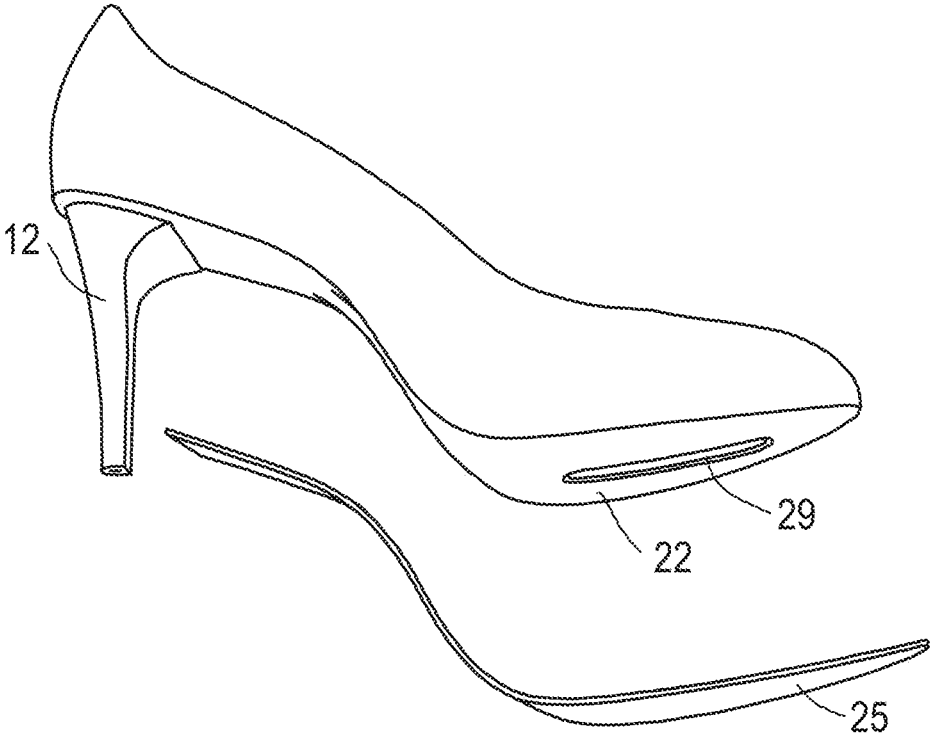
FIGS. 15 to 17 show three alternative outsole variations for the example of FIG. 13.

FIG. 13 shows an alternative arrangement to that shown in FIG. 12; here, the heel component 12 is secured to the skeleton insole so as to form a part of the base shoe and so is non-removable by a user. In this case, the cover 22 has a larger opening for the heel component than is required for the attachment boss 19 of the base shoe as shown in FIG. 12. However, the arrangement of the heel component and the attachment boss 19 is such that a narrow groove 32 is formed between the skeleton insole and the periphery of the heel component 12, to receive the edge of the cover around the heel opening therein, all as illustrated in FIG. 14. In this way, retention of the cover to the base shoe is assured, by stretching the cover over the upper end of the heel component to have the edges of the cover opening received within that narrow groove 32.

Figure 16:
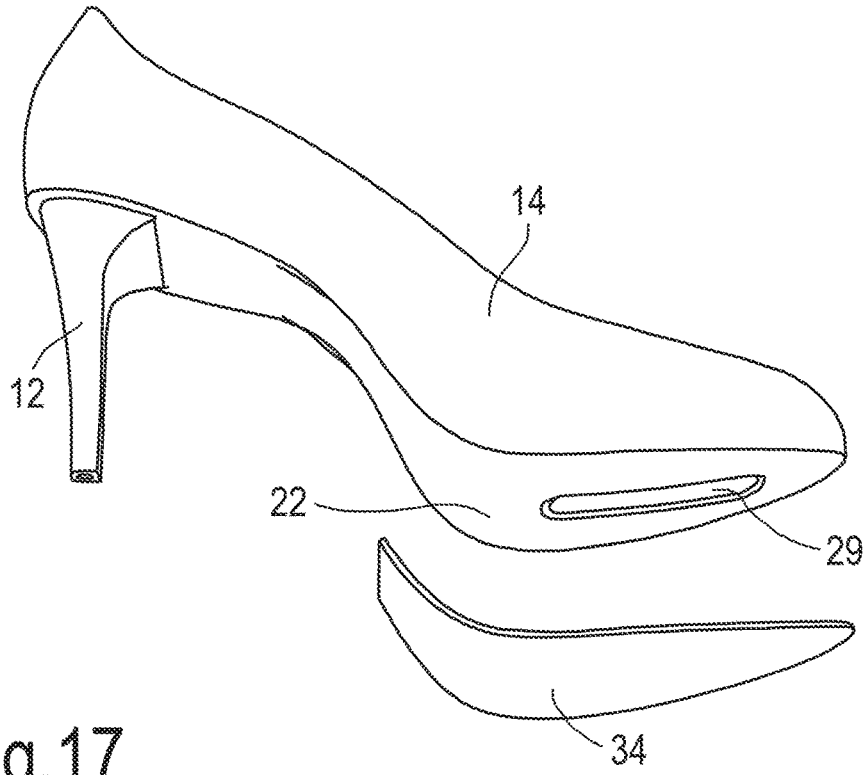
Figure 17:
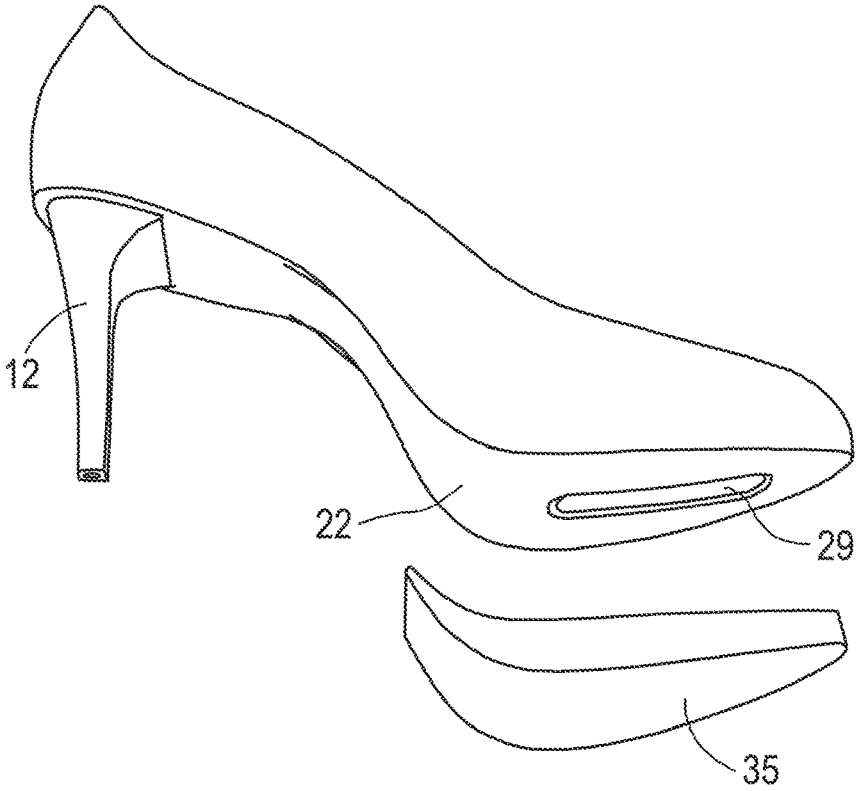

FIGS. 16 and 17 show alternative outsoles for use with a base shoe as has been described above and so having either a permanently secured heel component or a detachable heel component. In the arrangement of FIG. 16, the outsole 34 is relatively short so that the rear edge terminates in the instep region of the outer surface of the skeleton insole. In FIG. 17, there is shown an outsole 35 of a greater thickness than that of FIG. 16, so as to provide a platform for a high-heel shoe. For use with such an outsole, it may be necessary to increase the length of the heel component. The outsoles of FIGS. 16 and 17 may be attached in the same manner as will be described below, for longer outsoles.

Figure 18:
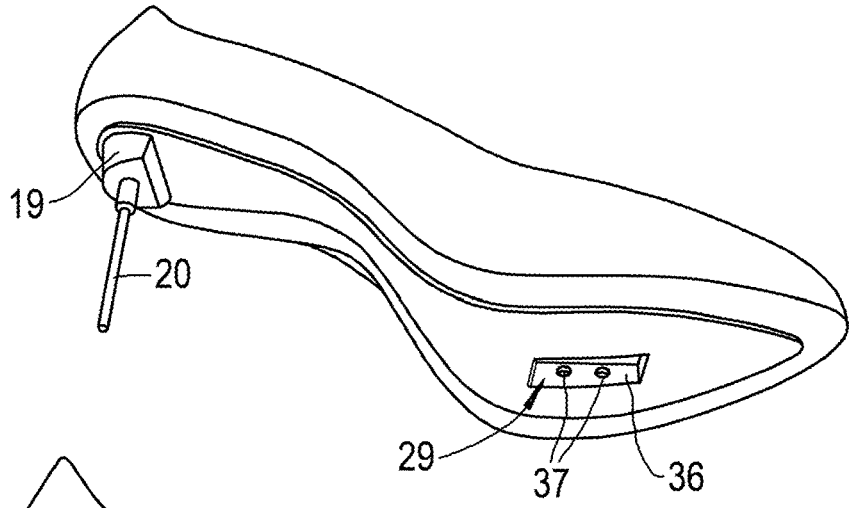
FIG. 18 is an isometric underplan view of the base shoe of FIG. 12.
Figure 19:
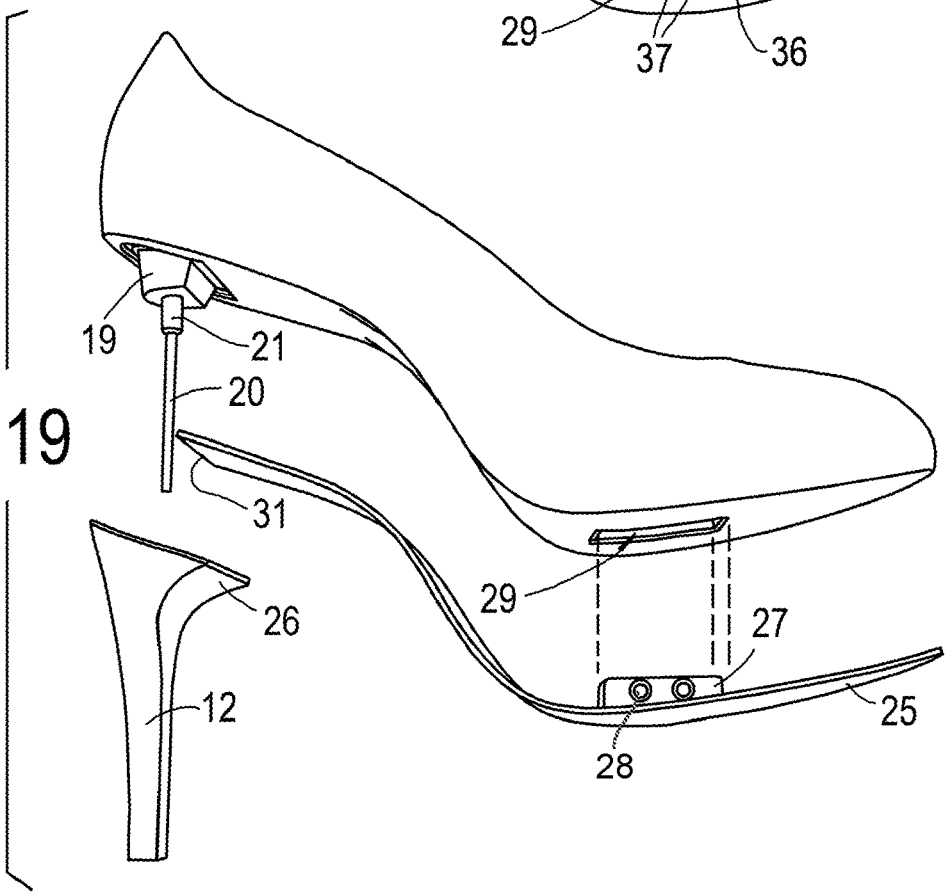
FIG. 19 shows the assembly of the heel component and outsole to the base shoe of FIG. 18.
Figure 20:
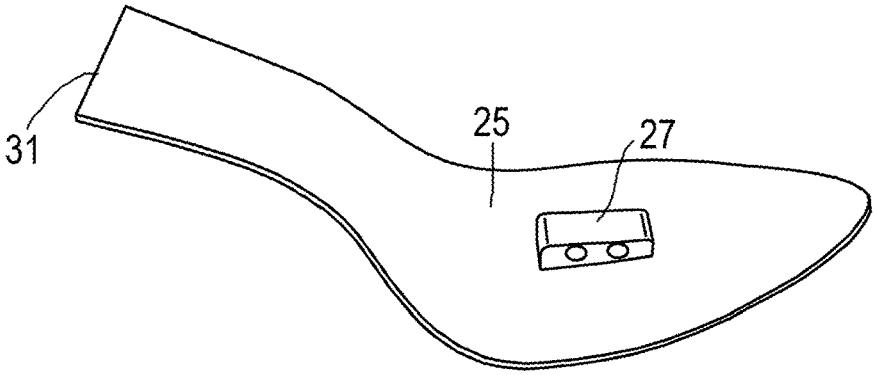
FIG. 20 is an isometric top view of the outsole used in FIG. 19.

FIGS. 18, 19 and 20 show in more detail the attachment of the outsole to the skeleton insole, by means of a support 27 provided on the upper surface of the outsole 25 and having a pair of bores in which are received two double-ended ball plunger mechanisms 28. As can be seen in FIG. 18, a side wall 36 of the socket 29 in the skeleton insole is provided with two recesses 37 to receive the balls of the ball plunger mechanisms 28; the opposed side wall of the socket 29 is similarly provided with recesses such that the outsole is securely, but detachably, connected to the skeleton insole.

Figure 21A:
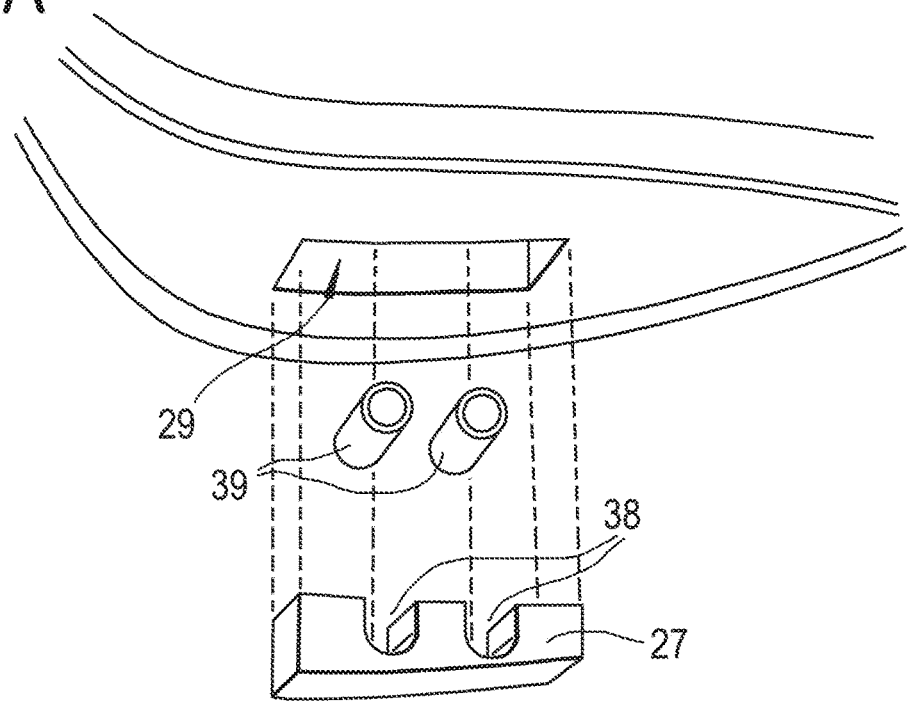
FIGS. 21A and 21B show the assembly of an outsole to the base shoe, using a ball plunger mechanism.
Figure 21B:
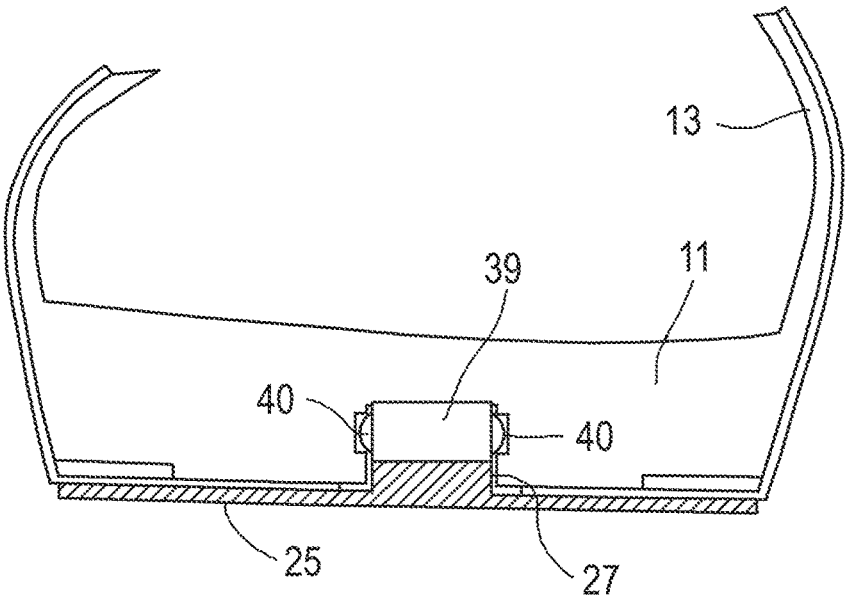

FIG. 21A shows on an enlarged scale a modified form of support 27, as having two U-shaped channels 38 in which are mounted tubes 39 of the ball plunger mechanisms. The tubes 39 may be held in position in the support channels 38 by means of an adhesive but in the alternative, the support could be provided with simple holes (as shown in FIGS. 18, 19 and 20) into which the tubes are pressed. FIG. 21B shows the overall assembly including the balls 40 of the ball plunger mechanisms received in the recesses 37, to hold the outsole 25 to the skeleton insole 11, with the lower edges of the cover 25 trapped therebetween.

Figure 22A:
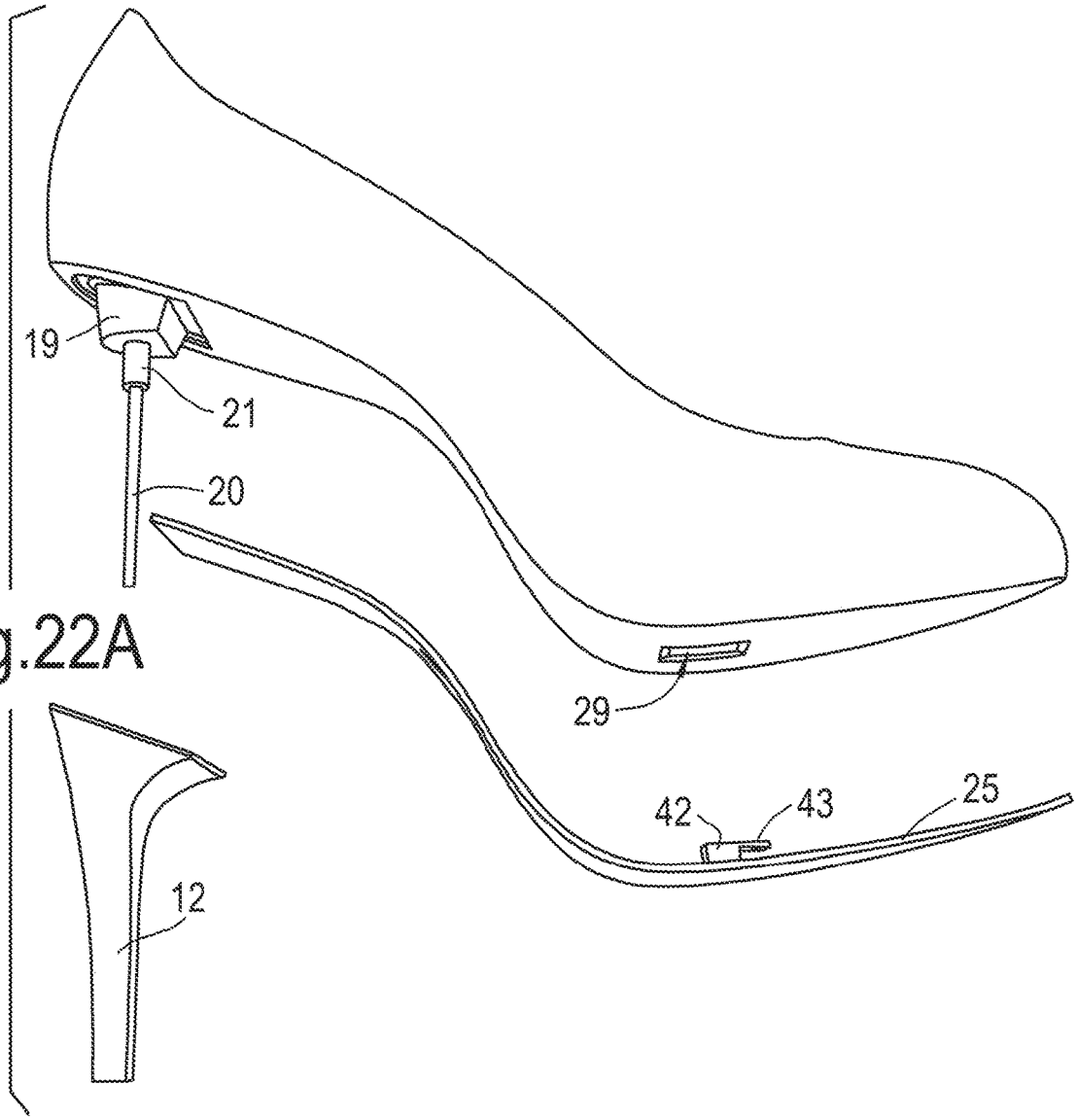
FIG. 22A shows an alternative arrangement for attaching an outsole to the base shoe.
Figure 22B:
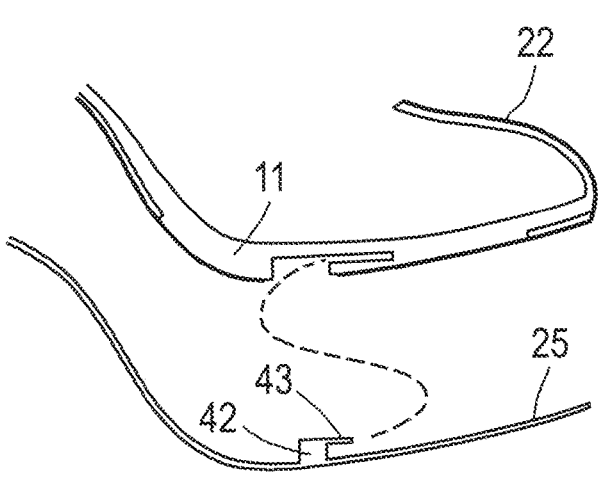
FIG. 22B illustrates the actual attachment of the outsole in the arrangement of FIG. 22A.

FIGS. 22A and 22B show an arrangement closely similar to that of FIGS. 18 to 20, except that a different arrangement is employed to hold the outsole to the skeleton insole. Here, the outsole is provided with an upstanding lug 42 having a forwardly directed leaf 43, the lug and leaf being receivable in a correspondingly formed socket 44 in the underside of the skeleton insole 11. The outsole is snap-fitted to the skeleton insole by feeding the leaf 43 into the socket and then pushing the outsole forwardly with respect to the base shoe, the materials of the lug and leaf, as well as the skeleton insole, deforming as required to allow the outsole to be snap-fitted to the skeleton insole. In all other respects, this arrangement corresponds to that described above with reference to FIGS. 18 to 20.

Figure 23A:
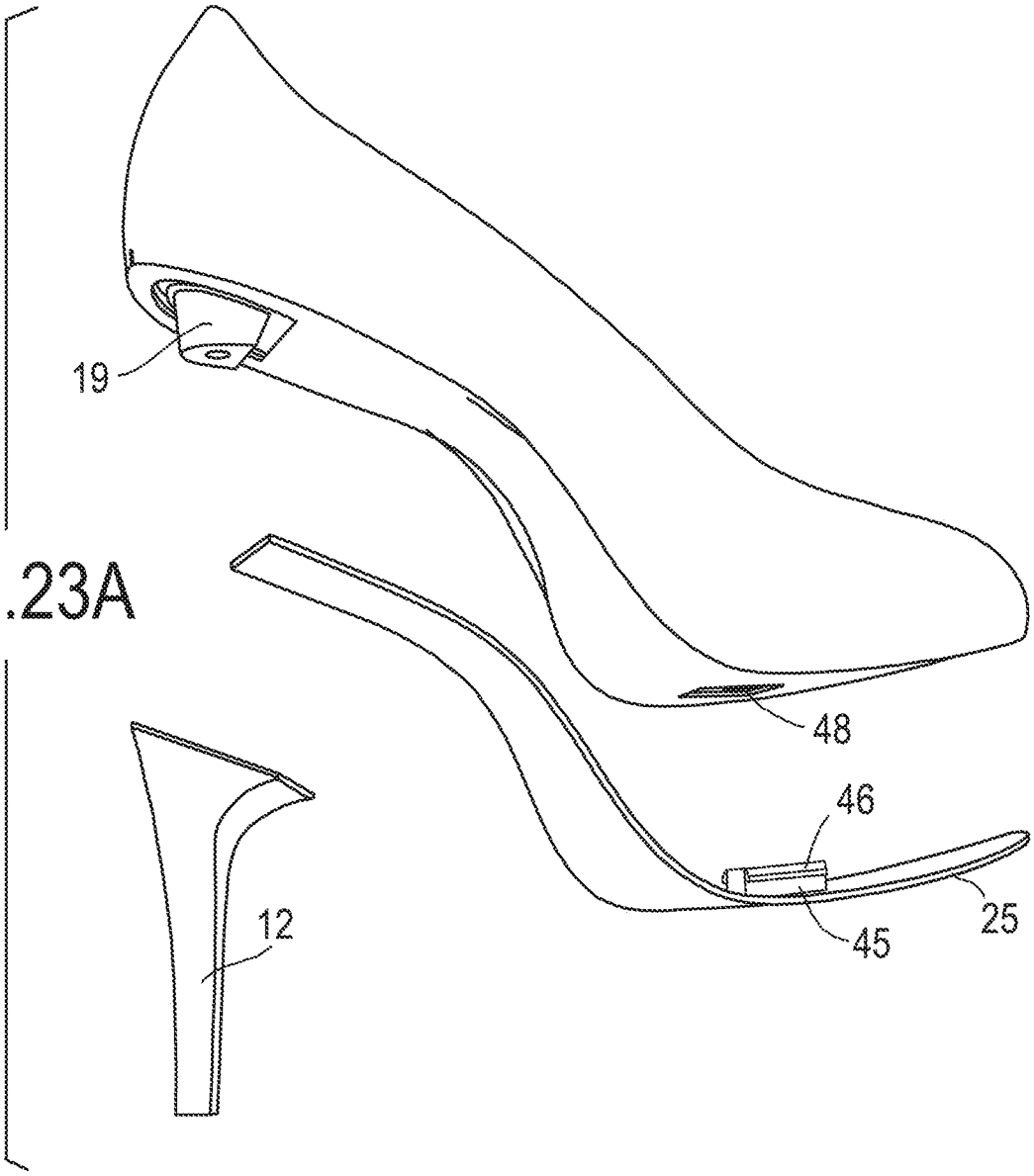
FIGS. 23A and 23B illustrate an alternative outsole attachment arrangement, FIG. 23C showing the actual attachment of the outsole of FIG. 23B to the base shoe of FIG. 23A.
Figure 23B:
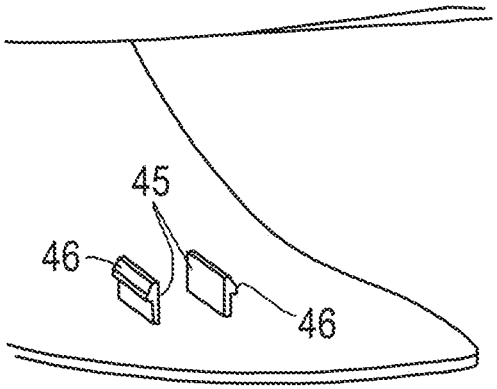
Figure 23C:
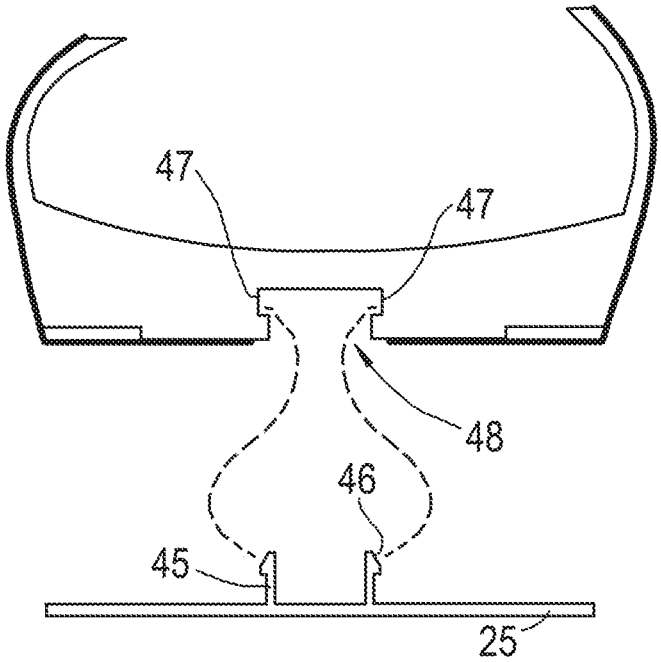

FIGS. 23A to 23C show yet another arrangement for the releasable connection between the outsole and the skeleton insole. Here, there are two lugs 45 upstanding from the upper surface of the outsole and each lug is provided with a barb 46 at its upper end, the lugs and being receivable in a correspondingly formed socket in the skeleton insole. Thus, as shown in FIG. 23C, the outsole may be fitted to the skeleton insole in order to trap the cover between the outsole and the skeleton insole when each barb 46 of the respective lug 45 snap-fits into the corresponding re-entrant groove 47 on the sides of the socket 48 in the skeleton insole.

Figure 24:
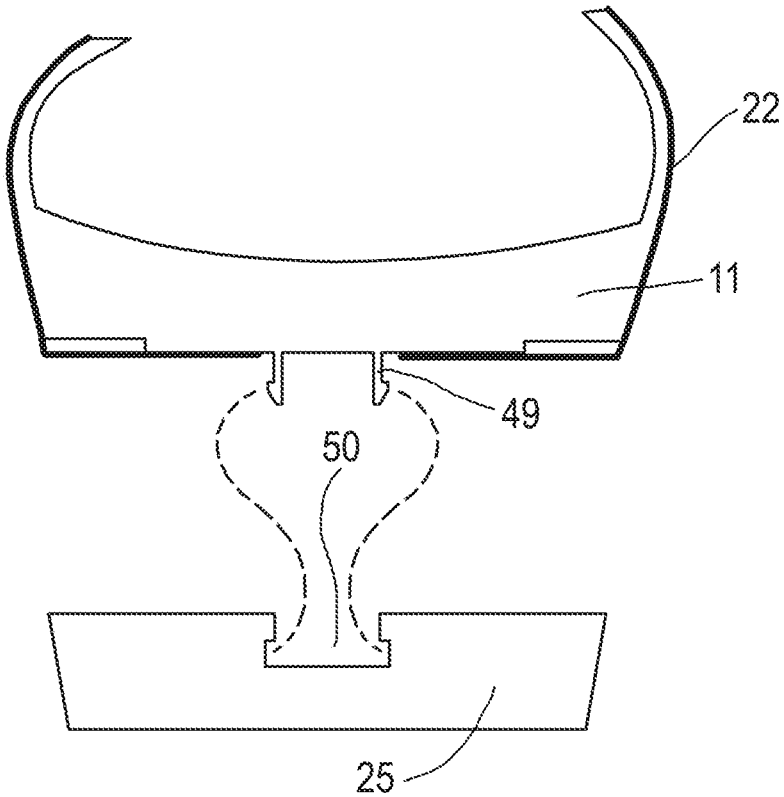
FIG. 24 shows an alternative attachment arrangement similar to that of FIG. 23C.

FIG. 24 shows essentially the same arrangement as has been described with reference to FIGS. 23A to 23C, except that here the lugs 49 are provided on the skeleton insole to project downwardly therefrom and the grooved socket 50 is in the outsole, which in this case must take the form of a platform sole in view of the required depth of the socket.

Figure 25A:
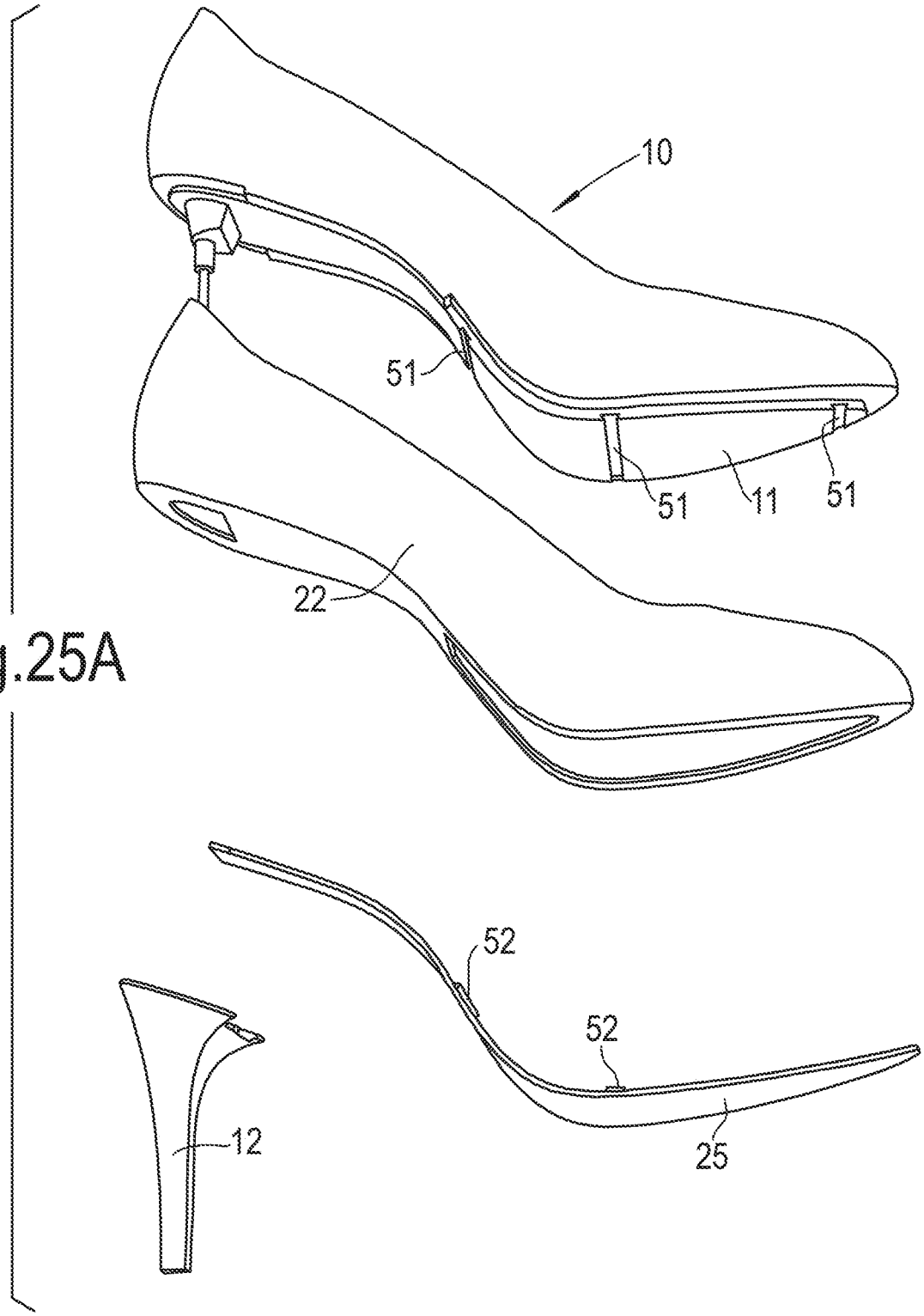
FIGS. 25A and 25B show yet another outsole attachment arrangement, FIG. 25A showing the entire shoe dissembled and FIG. 25B being a partial view on an enlarged scale of the dovetail attachment arrangement.
Figure 25B:
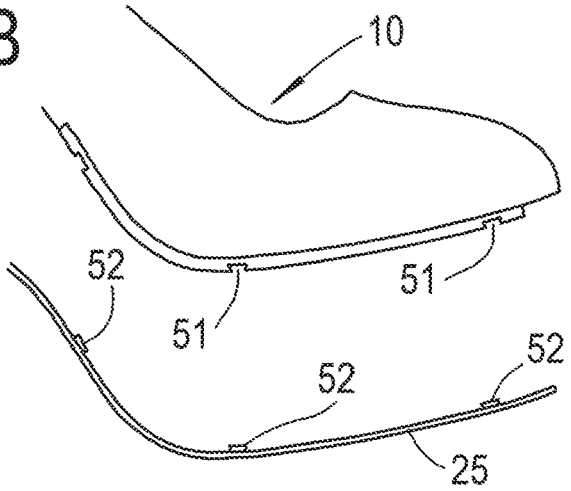

FIG. 25A is an exploded view of a high heel shoe having an alternative mechanism to attach the outsole to the skeleton insole. Here, there is a plurality (in this example, three) of grooves 51 extending laterally across the lower surface of the skeleton outsole, each groove being of dovetail cross-sectional shape. The outsole is provided with corresponding dovetail projections 52, receivable in the grooves 51 to secure the outsole to the skeleton insole. FIG. 25B shows on an enlarged scale this connection arrangement. In all other respects, the arrangement of FIGS. 25A and 25B corresponds to that of FIG. 2 and so will not be described again here.

Figure 26A:
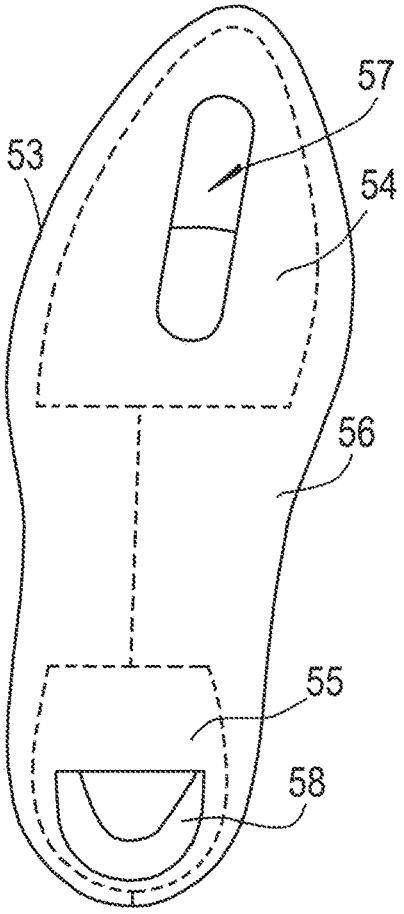
FIGS. 26A and 26B show the underside of the base shoe with two alternative covers fitted thereto.
Figure 26B:
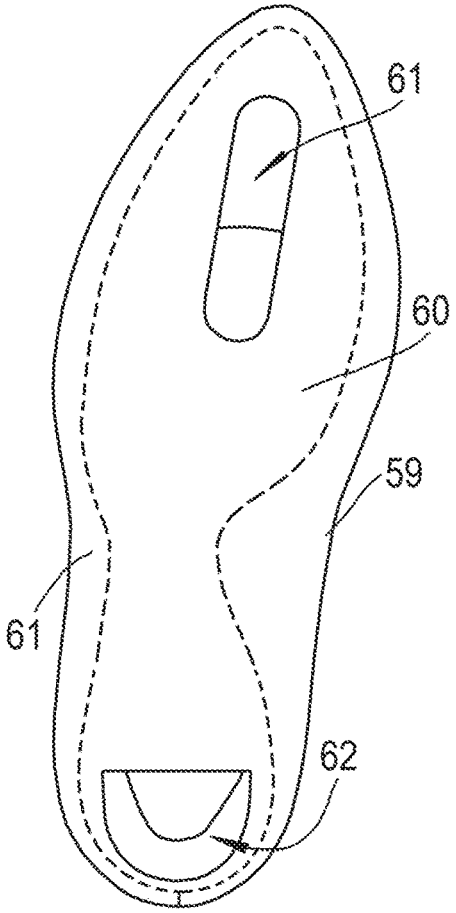

FIGS. 26A and 26B show two possible cutting and stitching designs for covers for use with a base shoe as described above. Cover 53 (FIG. 26A) utilises a front base panel 54 and a rear base panel 55, both stitched to the upper cover part 56 with the lines of stitching being shown by pecked lines. The front base panel 54 has an opening 57 for the connection mechanism, in register with the socket 29 in the skeleton insole, and the rear base panel 55 has an opening 58 for the attachment boss 19 on the skeleton insole. The cover 59 (FIG. 26B) utilises a single base panel 60 stitched to the upper cover part 61 with the lines of stitching being shown by pecked lines. The base panel 60 has an opening 61 for the connection mechanism, in register with the socket 29 in the skeleton insole, and a further opening 62 for the attachment boss 19 on the skeleton insole. In either case, if the base shoe has a non-removable heel component and a narrow groove 32 therearound as shown in FIG. 14, the rear opening in the respective panel may be made somewhat larger, so as to be able to fit over the upper end of the heel component and into the groove 32.

The invention claimed is:

1. A shoe assembly comprising:

a base shoe defined by a skeleton insole having a lower surface, a heel component, and an upper rising from a periphery of the skeleton insole, the upper defining at least one foot-retaining element;

a removable outsole connected to the skeleton insole to underlie the lower surface of the skeleton insole, there being a releasable mechanism having a first part on the skeleton insole and a second part on the outsole to interconnect the outsole to the skeleton insole; and a removable cover for the upper, the cover fitting over the base shoe to overlie said at least one foot-retaining element, the cover having a sole region provided with a sole opening for accommodation of the releasable mechanism interconnecting the outsole with the skeleton insole, and a heel opening through which at least a part of the heel component passes whereby a part of the cover is located between the lower surface of the skeleton insole and the outsole, thereby to retain the cover on the base shoe.

2. A shoe assembly as claimed in claim 1, wherein the releasable mechanism comprises a socket opening into the skeleton insole from the lower surface of the skeleton insole and a support of a complementary form to the socket projecting from the upper surface of the outsole and receivable in the socket.

3. A shoe assembly as claimed in claim 2, wherein a releasable snap-fit connection mechanism is provided between the support and the socket whereby the outsole is removable from the skeleton insole by breaking apart the releasable snap-fit connection mechanism.

4. A shoe assembly as claimed in claim 3, wherein the releasable snap-fit connection mechanism comprises a pair of resiliently deformable lugs upstanding from one of the skeleton insole and the outsole and each lug having a free edge, and each lug having a barb formation at each respective free edge, there being a correspondingly formed socket in the other of the skeleton insole and the outsole and having a respective recess for each barb.

5. A shoe assembly as claimed in claim 1, wherein the outsole is connected to the skeleton insole by means of a socket opening into the outsole from the upper surface of the outsole and a support of a complementary form to the socket projecting from the lower surface of the skeleton insole and receivable in the socket.

6. A shoe assembly as claimed in claim 1, wherein the heel component comprises a heel attachment element associated with the skeleton insole and a heel member removably attached to the heel attachment element, and the heel opening of the removable cover fits to the heel attachment element whereby the region of the cover around the heel opening in the removable cover is trapped between the skeleton insole and the heel member.

7. A shoe assembly as claimed in claim 6, wherein the heel attachment element comprises a heel pin projecting from the skeleton insole, and the heel opening of the removable cover fits around the heel pin.

8. A shoe assembly as claimed in claim 6, wherein the heel member releasably secured to the skeleton insole is interchangeable with at least one other heel member of the same or a different form.

9. A shoe assembly as claimed in claim 1, wherein the removable cover has an upper part to overlie the base shoe upper and at least one base panel to underlie at least part of the lower surface of the skeleton insole.

10. A shoe assembly as claimed in claim 9, wherein the at least one base panel includes one cover base panel provided with the sole opening for the releasable mechanism between the skeleton insole and the outsole, and the heel opening for the heel component.

11. A shoe assembly as claimed in claim 9, wherein the at least one base panel includes two cover base panels, wherein one of the two cover base panels is a front cover base panel being provided with the sole opening for the releasable mechanism between the skeleton insole and the outsole, and wherein the other of the two cover base panels is a rear cover base panel provided with the heel opening for the heel component.

12. A shoe assembly as claimed in claim 9, wherein the heel opening in the at least one base panel to receive the heel component is profiled to fit within a groove formed between the skeleton insole and the heel component, around at least part of a periphery of the heel component.

13. A shoe assembly as claimed in claim 9, wherein the heel opening in the at least one base panel to receive the heel component is profiled to be trapped between the heel component and the skeleton insole when the heel component is secured to the skeleton insole.

14. A shoe assembly as claimed in claim 1, wherein the at least one foot-retaining element of the upper comprises a vamp and a quarter panel, and the removable cover is configured to overlie the vamp and the quarter panel.

15. A shoe assembly as claimed in claim 1, wherein an insole is provided on the skeleton insole within the base shoe.

16. A method of manufacturing a shoe, the method comprising the steps of:

providing a base shoe defined by a skeleton insole having a lower surface, a heel component, and an upper rising from a periphery of the skeleton insole, the upper defining at least one foot-retaining element;

providing a removable outsole to underlie the lower surface of the skeleton insole, there being a releasable mechanism having a first part on the skeleton insole and a second part on the outsole to interconnect the outsole to the skeleton insole; and providing a removable cover for the upper, the cover having a heel opening and a sole opening in a base panel for the heel component and the releasable mechanism, respectively; in which method:

the cover is stretched over the base shoe to overlie the at least one foot-retaining element of the base shoe upper and to underlie at least part of the lower side of the skeleton insole;

the region of the base panel having the heel opening for the heel component is trapped between the heel component and the skeleton insole; and the outsole is fitted to the skeleton insole by way of the releasable mechanism, thereby trapping part of the cover base panel between the skeleton insole and the outsole, thereby retaining the cover on the base shoe.

17. A method as claimed in claim 16 and in which the heel component is removable from the base shoe, in which method the cover is fitted to the base shoe before the heel component is secured thereto, and following the fitting of the cover, the heel component is secured to the base shoe to trap part of the cover base panel between the heel component and the skeleton insole.

* * * * *